US005522572A

United States Patent [19]

Copeland et al.

[11] Patent Number: 5,522,572

[45] Date of Patent: Jun. 4, 1996

[54] SUPPORT APPARATUS WITH DUAL PALM RESTS FOR KEYBOARDS AND THE LIKE

[75] Inventors: Stephan Copeland, New York, N.Y.; Michael McAllister, Harleysville, Pa.

[73] Assignee: Westinghouse Electric Corporation, Pittsburgh, Pa.

[21] Appl. No.: 257,870

[22] Filed: Jun. 10, 1994

[51] Int. Cl.[6] ..... B68G 5/00

[52] U.S. Cl. ..... 248/118; 248/918

[58] Field of Search ..... 248/118, 118.1, 248/118.3, 118.5, 918, 176, 187; 400/715; 108/2, 5, 6, 50, 93, 137, 143

[56] References Cited

U.S. PATENT DOCUMENTS

| | | | |
|---|---|---|---|
| 399,266 | 3/1889 | Hull | 248/118 X |
| 2,270,948 | 1/1942 | Howe | 108/137 |
| 3,625,084 | 12/1971 | Low | 74/501 R |
| 3,638,973 | 2/1972 | Poletti | 285/184 |
| 3,894,496 | 7/1975 | Phillips et al. | 108/50 |
| 3,903,812 | 9/1975 | Cowley | 108/2 |
| 3,908,560 | 9/1975 | Horner | 108/2 |
| 3,908,561 | 9/1975 | Cowley | 108/6 |
| 4,431,329 | 2/1984 | Baitella | 403/55 |
| 4,632,349 | 12/1986 | Anstey | 248/281.1 |
| 4,863,124 | 9/1989 | Ball et al. | 248/918 X |
| 4,913,387 | 4/1990 | Tice | 108/143 X |
| 4,913,390 | 4/1990 | Berke | 248/176 |
| 4,964,748 | 10/1990 | McFadden | 403/55 |
| 4,976,407 | 12/1990 | Schwartz et al. | 248/118.3 |
| 5,050,826 | 9/1991 | Johnston | 248/118.3 |
| 5,072,905 | 12/1991 | Hyatt | 248/118 |
| 5,104,073 | 4/1992 | Van Beek et al. | 248/118 |
| 5,147,090 | 9/1992 | Mandell et al. | 248/118.1 |
| 5,158,256 | 10/1992 | Gross | 248/118.3 |
| 5,161,760 | 11/1992 | Terbrack | 248/118 |
| 5,219,136 | 6/1993 | Hassel et al. | 248/118 |
| 5,234,186 | 8/1993 | Powell | 248/118.1 |
| 5,294,087 | 3/1994 | Dabczyk et al. | 248/918 X |
| 5,362,025 | 11/1994 | Trom et al. | 248/187 X |

FOREIGN PATENT DOCUMENTS

| | | |
|---|---|---|
| 0342560 | 11/1989 | European Pat. Off. . |
| 2227278 | 7/1990 | United Kingdom . |
| WO91/14384 | 10/1991 | WIPO . |

*Primary Examiner*—Ramon O. Ramirez
*Assistant Examiner*—Korie H. Chan

[57] ABSTRACT

A support apparatus has dual, or left and right, palm rests. The apparatus is positionable to support an item like a keyboard in various inclined positions. The dual palm rests are mounted separately on a common carriage that slides in a plane back and forth relative to a front edge of an item on the apparatus. The manner of mounting the palm rests permits each palm rest to swivel about a generally vertical swivel axis and, additionally, move hingeally about a hinge axis that extends in a plane generally perpendicular to the associated swivel axis. The palm rests are connected to sets of torsion springs or the like to normally bias the palm rests about both the swivel axes and the hinge axes for clamping. Likewise, the sliding action of the carriage is preferably normally biased for clamping as well. Overall, the carriage, dual palm rests and biasing cooperatively effect a multiply adjustable clamping action on the from edge of the item. The support apparatus optionally includes a dual side-pad assembly positionable in either left or right use positions, or in a storage position. Each side panel is independently inclinable, and can carry a clip-on wrist rest. The side panels provide surfaces for use, for example, with a cursor positioning device like a mouse or a trackball. For the cursor positioning device, there is also a storage device which is removably attachable to the edges of the support apparatus, for releasably storing the cursor positioning device during non-use.

20 Claims, 5 Drawing Sheets

SUPPORT APPARATUS WITH DUAL PALM RESTS FOR KEYBOARDS AND THE LIKE

BACKGROUND OF THE INVENTION

1. Field of the Invention

The invention relates to the field of support apparatus for keyboards and the like, and in particular concerns a support apparatus with dual, or left and right, palm rests. The apparatus is positionable to support a keyboard or like item in various inclined positions. The dual palm rests are mounted separately on a common carriage, which carriage slides in a plane back and forth relative to a front edge of working surface of the apparatus.

The manner of mounting the palm rests permits each palm rest to swivel about a respective swivel axis. The swivel axes generally intersect perpendicularly a plane that is defined by the sliding of the carriage. Additionally, the manner of mounting the palm rests involves each palm rest being hinged about a respective hinge axis. Each hinge axis extends in a plane generally perpendicular to the associated swivel axis. In practical use, the plane defined by the sliding carriage is generally horizontal, the swivel axes are generally vertical, and the hinge axes are generally horizontal.

The palm rests preferably are connected with springs or the like for biasing the palm rests about both the swivel axes and the hinge axes. Additionally, the carriage is likewise preferably connected with a spring or springs for biasing the carriage to move normally into the front edge of the working surface of the apparatus. Overall, the palm rests, carriage and springs cooperate to effect a multiply adjustable clamping action relative to the relatively stationary working surface of the support apparatus.

2. Prior Art

It is known combine a keyboard support assembly with a palm rest on a carriage. The carriage permits displacement of the palm rest relative to a front edge of a keyboard on the support assembly. An example of a palm rest with carriage is disclosed by U.S. Pat. No. 5,219,136 —Hassel et. al. The carriage is adjustably repositioned via untightening and tightening a set of wing nuts. An advantage in such a carriage arrangement is that the carriage and palm rest cooperatively provide a clamping engagement on a front edge of a keyboard on the keyboard support assembly.

The known keyboard support assemblies, of which U.S. Pat. No. 5,219,136 discloses one example, are disadvantageous for use with many of the commercially available keyboards. Two types of keyboards particularly cause problems.

One is the split keyboard. The split keyboard is partitioned midway between the left and right edges, each half being pivotably attached to the other half about a ball joint at the upper edge. The two halves can be locked in various positions such that each is slightly spread apart from the other along their front edges, and/or inclined, relative to the horizontal, in separate planes. The split keyboard is advantageous for allowing an operator to position his or her arms in a more natural and/or comfortable position than possible with a straight keyboard. While the known keyboard support assemblies are limitedly suitable for clamping onto the front edge of a straight keyboard, they are plainly ill-suited for clamping onto the bidirectional front edge(s) of the split keyboard.

The other problematic keyboard for clamping is any of the commercially available laptop computers, each which typically has an integral keyboard. The commercially available laptop computers vary considerably in regards to thickness (i. e., height). For instance, there is often an inch (2.5 cm) or more difference between the thickness of the keyboards of laptops and the thickness of non-laptop keyboards. In consequence, the known keyboard support assemblies are not variable enough in their adjustability to meet all the variety in the thicknesses of commercially available keyboards, especially laptops.

In laptops, there also is much variety in the location of ports for disks, diskettes, cards and the like. It is generally popular to locate these ports in one of the front, rear, left or right sidewalls of the keyboard. Beyond that much of a generality, there is no particular one of the sidewalls in which the ports typically are located. The problem is, that the known keyboard support assemblies have poorly placed clamping members which will align on one or more of the different types of laptops such that the clamping members will obstruct a port. Not only are ports at risk of being obstructed, but other times what is obstructed is a connection for a 110 VAC line-cord or the like. Indeed, in one laptop, the front sidewall carries a trackball. The keyboard support assembly disclosed by U.S. Pat. No. 5,219,136 typifies the problems in the prior art. That is, it has a crosswise palm rest which would directly interfere with the trackball of that laptop when positioned against the front edge thereof.

For the above reasons and many more, the known keyboard support assemblies are disadvantageous for universal compatibility with all the various keyboards, which vary so much in shape and arrangement. What is needed is keyboard support apparatus which overcomes the problems of the prior art.

Furthermore, it would be advantageous to provide keyboard support assemblies with more accessories that complement use of the support assembly while supporting keyboards, other electronic interface devices, or, indeed, even non-electronic items such as ordinary writing cases and the like. Such accessories include side pads for use with cursor positioning devices and the like. The side pads preferably are movable between use and storage positions. Additional, other accessories include receptacles for storing cursor positioning devices, lamps, document holders, and so on. These and other complementary accessories are not adequately provided and/or addressed in the prior art keyboard support assemblies.

SUMMARY OF THE INVENTION

It is therefore an object of the invention to combine a support apparatus with dual, or left and right palm rests, to effect more natural positioning of an operator's arms during use of a keyboard or other item on the apparatus.

It is another object of the invention to mount the above dual palm rests on a common carriage that slides in a plane back and forth relative to a front edge of the apparatus.

It is a further object of the invention to mount the dual palm rests separately on the common carriage so that they swivel about respective swivel axes which generally perpendicularly intersect the plane defined by the sliding of the carriage.

It is still a further object of the invention to involve the palm rests with a hinged action so that each pivots about a respective hinge axis, which two hinge axes extend in planes generally perpendicular to the swivel axes.

It is yet another object of the invention that each palm rest preferably be connected with springs for biasing the palm rests about both the swivel axes and the hinge axes, which, in combination with biasing for the carriage, overall can effect a multiply adjustable clamping action on a front edge of an item, such as a keyboard, on the support assembly.

It is also an object of the invention that the above support apparatus be positionable to support a keyboard or other item in various inclined positions, and be combined with a slidably retractable side pad for use with other items like a cursor positioning device (e.g., a mouse or trackball) and so on. The side pad can also be adjustable to vary the relative inclination between the side pad and support apparatus.

It is furthermore an object of the invention that the above side pad include a slidably coupled wrist support that is positionable in use positions and/or storage positions.

It is still another object of the invention to provide the above support apparatus and retractable side pad with a storage receptacle for a one cursor positioning device. The storage receptacle preferably releasably retains the cursor positioning device and removably attaches to an edge of the support apparatus.

These and other aspects and objects are provided according to the invention in a support apparatus that combines a base portion with dual palm rests. The base portion defines a working surface on which to place a keyboard or other item, and is positionable in various inclined positions. The dual palm rests are mourned on a carriage movably connected to the base portion for displacement in a from to back direction relative to the front edge of the keyboard or item on the support apparatus. The carriage is removable from the base portion such that the base portion is used without palm rests.

The palm rests are interconnected with the carriage such that each palm rest can swivel about a swivel axis generally perpendicular to a plane defined by the displacement of the carriage, and such that each palm rest is hinged about a hinge axis that extends in a plane generally perpendicular to the associated swivel axis.

The palm rests and carriage are connected to a set of springs such that each palm rest is biased about the swivel and hinge axes thereof, and the carriage is biased normally toward the front edge of the keyboard or item on the support apparatus. By all these arrangements, the carriage, dual palm rests, and springs cooperatively effect a multiply adjustable clamping action for clamping front edge portions of an item on the support apparatus. Such items typically include computer keyboards, split keyboards, laptop computers and other electrical interface device like a graphical tablet, as well as non-electrical items like a writing case which includes a compartment for writing instruments and a writing surface for stationery.

The support apparatus preferably includes a pair of adjustable abutment members releasably securable to the base portion. The abutment members extend up from the working surface for abutting various positions of a rear portion of the keyboard on the working surface. The abutment members are adjustably positionable via slots which are dimensioned to accept such accessories as lamps, document holders and the like.

The palm rests define upper surfaces and concave rearward surfaces shaped for abutting against front edge portions of a keyboard chosen from one of a computer keyboard, a split computer-keyboard, and a laptop computer with an integral keyboard. The advantage in such concave rearward surfaces is that, because commercially available keyboards vary so much in thickness, the concave rearward surfaces define a flange to be positioned relatively flush with the home row of the chosen keyboard (i.e., the row with the space bar).

The base portion preferably defines a passageway below the working surface, and this passageway extends in a left to right direction relative to the front edge of the keyboard or other item on the working surface. The support apparatus preferably includes a dual side-pad assembly that is slidably disposed in the passageway. The dual side-pad assembly comprises left and right side pads interconnected with a shaft for counter rotation relative to each other. The dual side-pad assembly has a storage position generally occupying the passageway. Additionally, the dual side-pad assembly has left and right extended positions in which either the left or the right side pad extends out from below the working surface for use, for example, with a cursor positioning device.

Moreover, the dual side-pad assembly has relatively extreme left and right extended positions in which either the left or the right side pad is permitted to be rotated to various inclined positions relative to the working surface. The side pad which may be so inclined remains in place via a frictional engagement with a resilient sleeve which acts to brake the side pad in place. This resilient sleeve covers that portion of the shaft which extends between the left and right side pads. Each side pad is screwed into the adjacent end of the shaft such that counter rotation of the side pads on the shaft either results in the side pads spiraling closer together or further apart, depending on the directions of rotation. Spiraling the pads toward or away from one another correspondingly changes the amount of squeeze on the resilient sleeve between the two pads, which further changes the degree of braking effected by the resilient sleeve to stabilize one pad in an inclined position.

It is advantageous that one of the side pads can be formed with a peripheral groove. When that occurs, then a wrist rest according to the invention can be removably attached to that one side pad via a gripping finger extending in the groove. The wrist rest is variably positionable on the side pad between storage and use positions.

It is also can be advantageous to include a storage receptacle which can store a cursor positioning device during non-use. The storage receptacle includes a first resilient element for removably attaching the storage receptacle to the base portion, and a second resilient element for releasably retaining the cursor positioning device.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIG. 1 a perspective view of a support apparatus according to the invention;

DETAILED DESCRIPTION OF THE PREFERRED EMBODIMENTS

Figure 1:
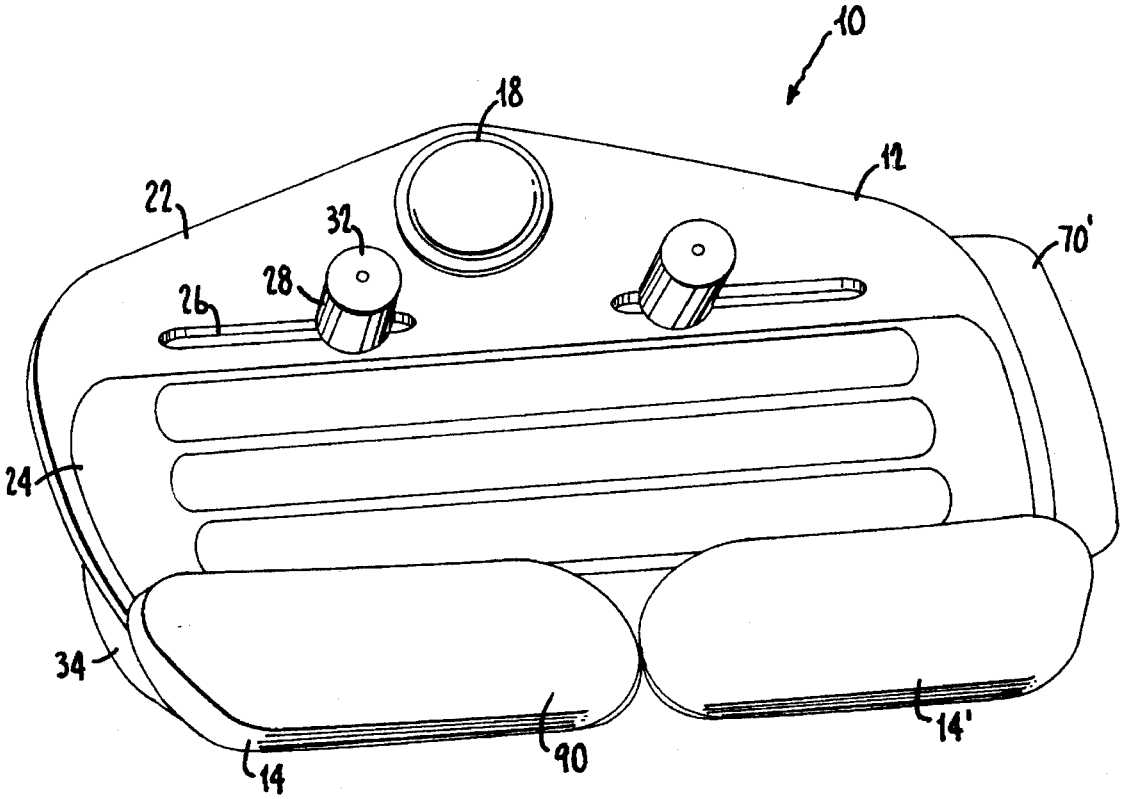

In FIG. 1, a support apparatus 10 according to the invention combines a relatively stationary base portion 12 with variably positionable dual palm rests, 14. The base portion 12 is preferably mounted to a mounting structure (not shown) such as a locking support arm, via mounting hardware 18. However, the base portion 12 is suitable for setting on a table top (not shown), preferably with adjustable back legs (not shown) such that the base portion 12 is positionable in various inclined positions. In the drawings, the apparatus 10 is shown generally horizontal. However, the apparatus 10 can be oriented in other orientations, and accordingly, terms like "up" and "down", "left" and "right", and "front" and "rear" are used merely for convenience in this description and do not limit the apparatus 10 to particular orientations.

The base portion 12 defines a generally flat working surface 22 for carrying an item such as a keyboard (not shown), e.g., one of a computer keyboard, a split computer-keyboard, and/or a laptop with its own integral keyboard. Other items include other electronic interface devices, an example being a graphical tablet or data tablet, as well as non-electrical items such as a writing case which includes a compartment for storing writing instruments and a writing surface for stationery and the like. The working surface 22 includes a negative cavity which receives a correspondingly sized resilient pad 24 that increases the frictional engagement between the keyboard and support apparatus 10.

The base portion 12 also defines a pair of slots 26 through the working surface 22, positioned rearward of the resilient pad 24 and extending in a common left to right direction. Each slot 26 slidably receives a pin (not in view) carrying a resilient bumper 28 and rigid cap 32 combination. The cap 32 is resiliently biased via the inherent resiliency in the bumper 28 to seek a plane perpendicular to the bumper 28. Each bumper 28 is variably positionable along the respective slot 26 and is releasably lockable via a nut (not shown) tightenable on the pin. The slots are also shaped and sized to accept releasably attachable accessories (not shown) such as lamps and document holders and the like, which would have appropriately configured legs to attach to and extend up from the slots 26.

Figure 2:
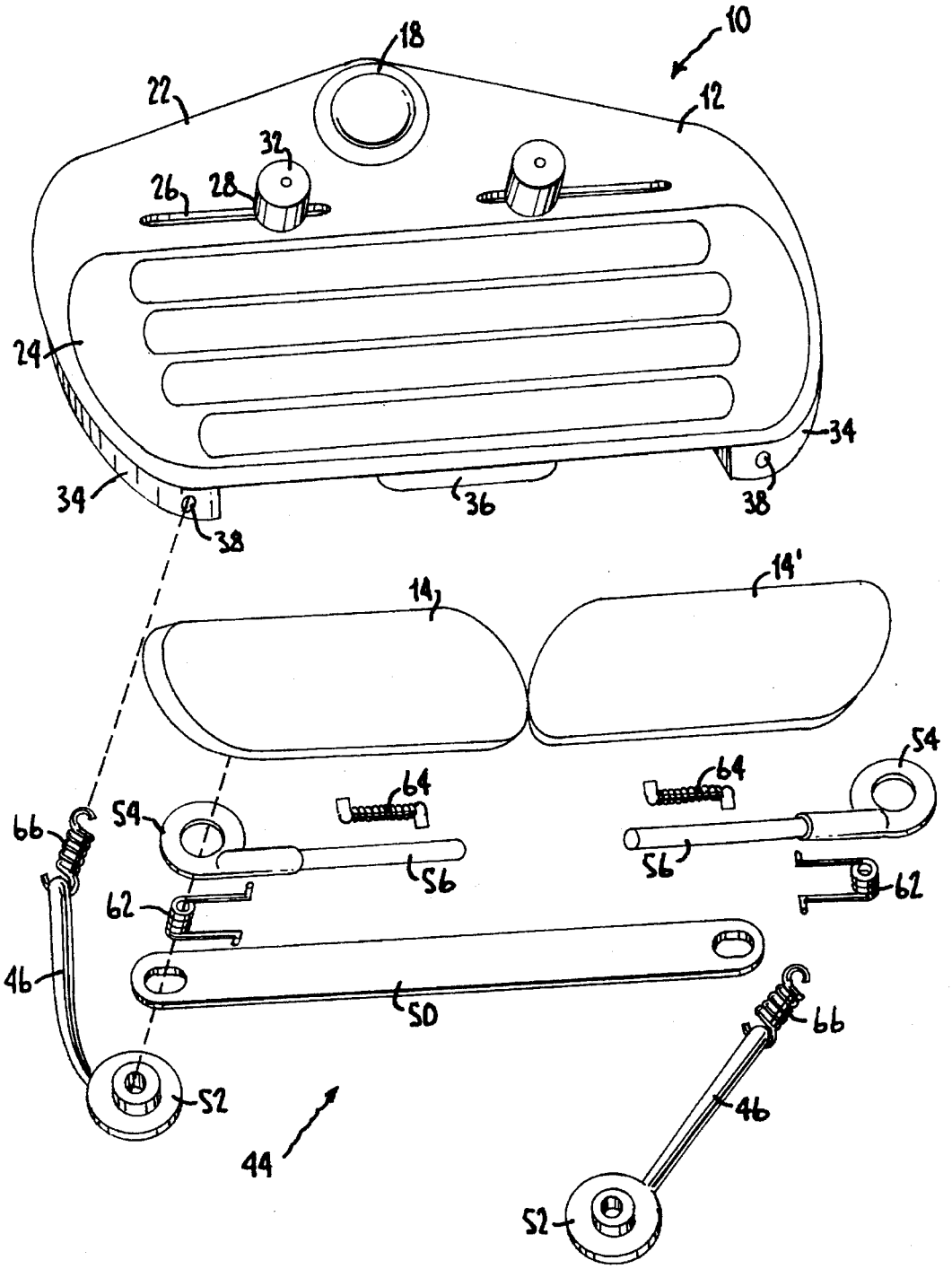
FIG. 2 is an exploded perspective view corresponding to FIG. 1.
Figure 3:
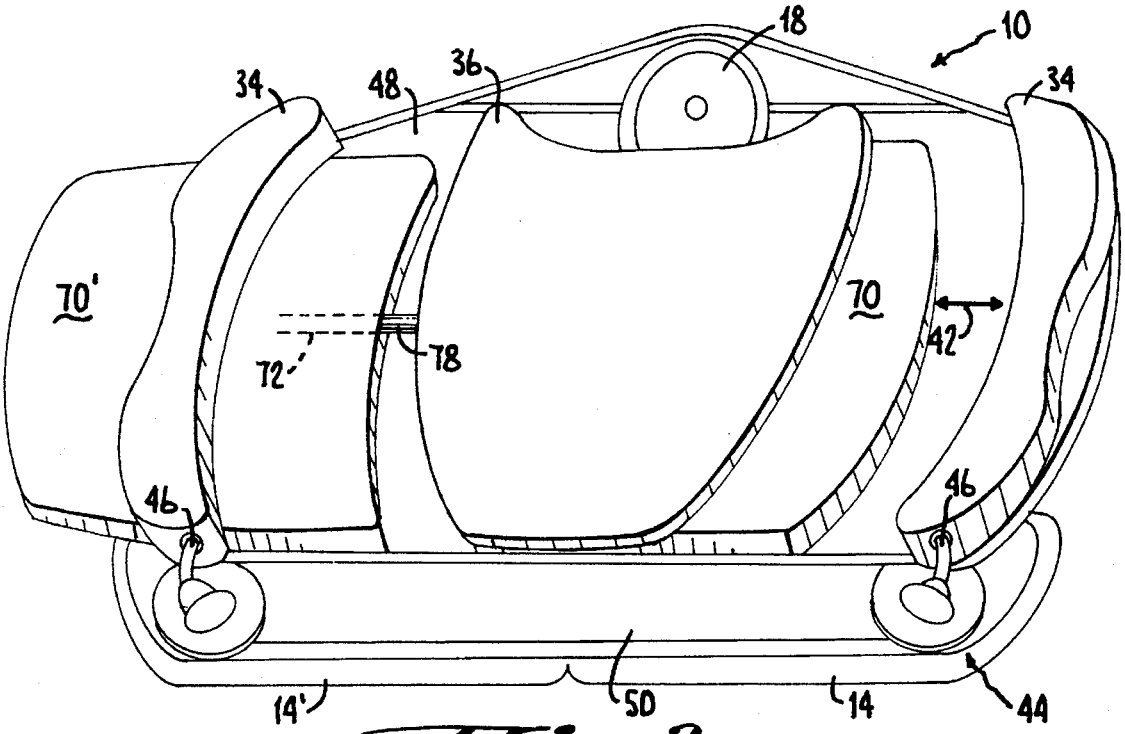
FIG. 3 is a bottom perspective view corresponding to FIG. 1.

In FIG. 3, the base portion 12 has an underside to which is attached a bracket system comprising mirror image outer portions 34 flanking a central portion 36. Each outer portion 34 is bored through in the front to rear direction to define a track 38 (see also FIGS. 1 and 2). The central portion 36 cooperates with the outer portions 34 and base portion 12, as shown in FIG. 3, to define a passageway 42 extending in the left to right direction. A dual side-pad assembly 48 (see also FIG. 4) slides in the passageway 42 from a retracted position (e.g., FIG. 2, or as partly retracted in FIG. 1) to either a left or a right extended position (FIG. 3 shows a right extended position). The outer portions 34 include scalloped portions to provide a user with more conveniently graspable left and right edges than known before.

As shown by the exploded view of FIG. 2, the dual palm rests 14 are mounted separately on a carriage 44, which preferably has rails 46 that are slidably disposable in the tracks 38. That is, the rails 46 slide within the hollow cavities or tracks 38 defined in the outer bracket portions 34. The carriage is selectively removable from sliding engagement with the base portion 12 via withdrawal of the rails 46 from the tracks 38 in the outer bracket portions 34. The rails 46 are interconnected across their front ends by a cross bar 50 that extends in the left to right direction. Each apertured end of the crossbar 50 is positioned between a ring 52 on the adjacent rail 46 and another ring 54 carrying a spindle 56. The ring 52 on the rail 46 has a bushing pivotably carrying the ring 54 with the spindle 56. The cross bar 50 and rails 46 are relatively fixed while the spindle 56 is permitted to swivel relative to the crossbar and rails 50 and 46.

Each spindle 56 is coupled to the same-sided palm rest 14 in a manner wherein the palm rests 14 are said to be hinged to the spindles 56 to move angularly about generally horizontal hinge axes. The swivel connection between each rail-ring 52 and adjacent spindle-ring 54 incorporates a torsion spring 62. The torsion springs normally biases the left palm rest 14 counterclockwise (when viewed from above) and the right palm rest 14' clockwise. The palm rests 14 are connected with another set of torsion springs 64 such that each palm rest's rearward edge is biased downwardly against the base portion's front edge. Moreover, the rails 46 are connected to coil springs 66 (like tension springs, or even shock cords and the like) to bias the carriage 44 in a normally retracted position (e.g., FIG. 1 ). Another embodiment replaces the torsion springs 62 and 64 with leaf springs which provide an equivalent actions. Overall, the carriage 44, the palm rests 14 and springs 62–66 cooperatively permit resilient clamping of the palm rests 14 on various sized keyboards placed on the base portion 12.

Figure 4:
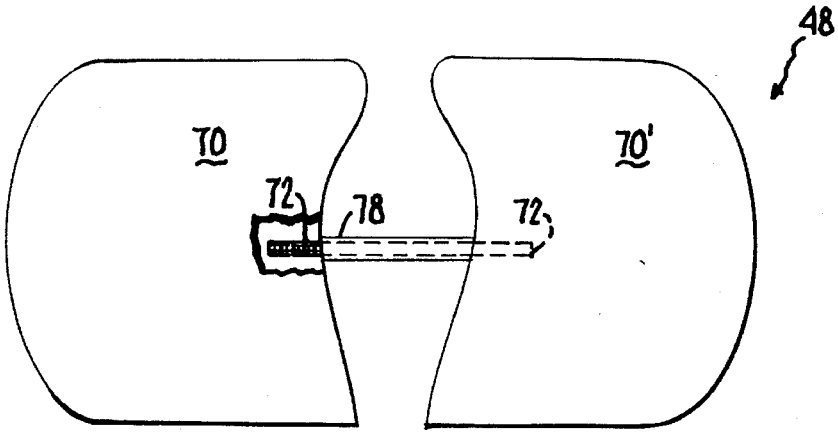
FIG. 4 is a plan view of the dual side-pad assembly in FIG. 3.

In FIGS. 3 and 4, the dual side-pad assembly 48 comprises left and right side pads 70 and 70' interconnected by a middle shaft 72 extending in the left to right direction. Each side pad 70 is formed with internal thread and is coupled to an adjacent end of the shaft 72 formed with complementary external thread. The shaft 72 has a central portion exposed between the side pads which is covered by a relatively close-fitting resilient sleeve 78. The side pads, shaft and sleeve 70, 72 and 78 cooperate such that the side pads 70 and 70' can be positioned in various planes relative to each other and yet the side pads 70 and 70' are braked by the sleeve 78 to stably hold their positions relative to one another.

In use, the dual side-pad assembly 48 has relatively extreme left and right extended positions, relative to the base portion 12, in which either the left or the right side pad 70 or 70' is permitted to be rotated to various inclined positions relative to the working surface 22. The side pad 70 or 70' which just happens to be so inclined remains in place via a braking action, or via the frictional engagement, with a resilient sleeve 78, which acts to brake the side pad 70 or 70' in place. Since the shaft 72 is threaded into the side pads 70, counter rotation of the side pads 70 on the shaft 72 either results in the side pads 70 spiraling closer together or further apart, depending on the directions of rotation. Spiraling the side pads 70 toward or away from one another correspondingly changes the amount of squeeze on the resilient sleeve 78 between the two pads 70, which further changes the degree of braking effected by the resilient sleeve 78 to stabilize one pad 70 or 70' in an inclined position.

The dual side-pad assembly 48 is positionable as a unit in the passageway 42 (FIG. 3) to various extended positions to provide a working surface, such as, for example, a surface for a cursor positioning device (not shown), like a mouse or trackball and the like, on either side of the base portion 12. The dual side-pad assembly 48 has opposite extreme positions (not shown), and in these opposite extreme positions, one or the other of the side pads 70 will clear the adjacent edge of the base portion 12, and so is free to be rotated relative to the base portion 12. Thus that one side pad 70 can then be inclined relative to the base portion 12 to suit the operator during use of the cursor positioning device. As mentioned above, the squeeze on the resilient sleeve 78 is variable by the operator. This way, the operator can select or dial in the desired amount of braking action, including the associated amount of force required to overcome the braking action.

Figure 5A:
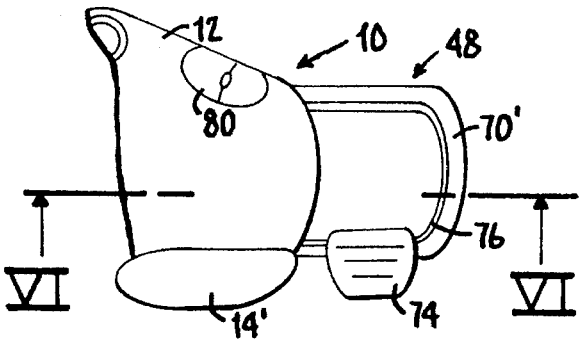
FIG. 5*a* is, in accordance with the invention, a top plan view, partly broken away, of a storage receptacle, for a cursor positioning device, removably coupled to the base portion, and, additionally, a wrist rest removably coupled to an alternative side pad.
Figure 5B:
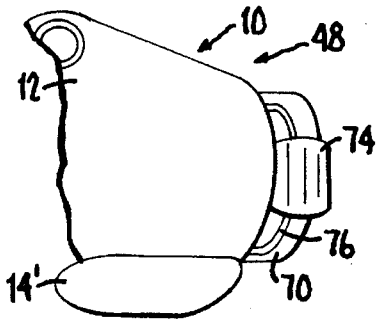
FIG. 5*b* is a top plan view corresponding to FIG. 5*a* except that the alternative side pad is in a relatively stored position.
Figure 6:
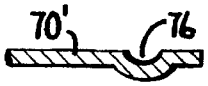
FIG. 6 is an enlarged sectional view, partly broken away, taken along line VI—VI in FIG. 5*a;*

An additional inventive aspect of the keyboard support apparatus 10 includes a clip-on wrist rest 74 (FIGS. 5*a* and 5*b*) cooperating with specially formed peripheral grooves 76 in an alternative side pad 70. The wrist rest 74 has enlargements (not shown) for extending into the grooves 76, and is positionable in various use positions (e.g., FIG. 5*a*) to provide support to the operator's wrist/forearm during use of the cursor positioning device. The wrist rest 74 has stored positions (e.g., FIG. 5*b*) on the side pad 70 during non-use. Alternatively, during non-use, since the wrist rest 74 is removable, the wrist rest can be simply detached from the side pad 70, thereby permitting the side pad 70 to be stored below the working surface 22.

Figure 7:
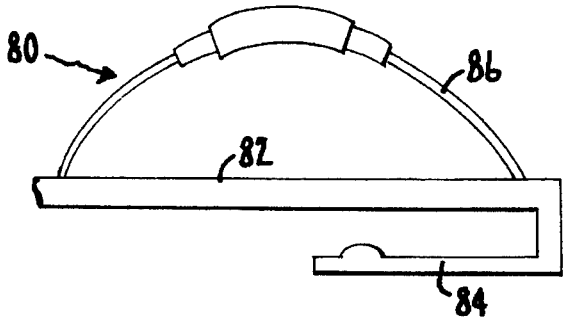
FIG. 7 is a side elevational view of the storage receptacle in FIG. 5*a;*

The support apparatus 10 according to the invention further comprises a clip-on storage receptacle 80 (FIGS. 5*a* and 7) for storing the cursor positioning device during non-use on a peripheral edge of the base portion 12. The storage receptacle 80 comprises a plate 82 with a relative bottom formed with a resilient clip 84 and a relative top combined with a resilient band 86. The clip 84 is shaped and arranged for removable attachment to the peripheral edges of the base portion 12. The resilient band 86 is sized for resiliently retaining the cursor positioning device to the plate 82.

With general reference to all the FIGURES, the support apparatus 10, before use, is positioned with the carriage, dual palm rests and dual side pads 44, 14 and 70 all in each's respective storage position. An operator releasably mounts an item like a keyboard to the apparatus 10 by the following procedure. The operator positions the bumpers 28 to abut desired positions on the keyboard, preferably not obstructing any port or the like. For example, with some laptops, the only nonobstructive positions along the length of the rear sidewall is only at the corners between the rear and left and right sidewalls. Next, an operator would slide the carriage 46 to an extended position and swivel the palm rests 14 to out-of the way positions, thus permitting a keyboard to be placed on the working surface 22, abutting the bumpers 28. The operator does so, perhaps causing the resiliently biased caps 32 to catch the rear edge of the keyboard.

After that, the carriage and palm rests 44 and 14 are moved to desired positions. First, the palm rests 14 are rotated open about their hinge axes to define jaws for gripping a front edge of the keyboard. Next, the palm rests 14 are positioned in a desired swivel angle. For example, if the keyboard is a bidirectional split keyboard, it may be desirable to swivel the palm rests 14 in complementary angles. On the other hand, if the keyboard is a straight keyboard but includes ports or a trackball and the like on the front edge, then it is desirable to swivel the palm rests 14 to an angle of attack on the front corners of the keyboard. Finally, the carriage 44 is released to return under biasing to the retracted position as the palm rests 14 are permitted to close about their hinge axes on the front edge of the keyboard. In sum, the support apparatus 10 effects a multiply adjustable clamping action, mainly on the front edge of the item to be clamped, such as a keyboard.

Figure 8:
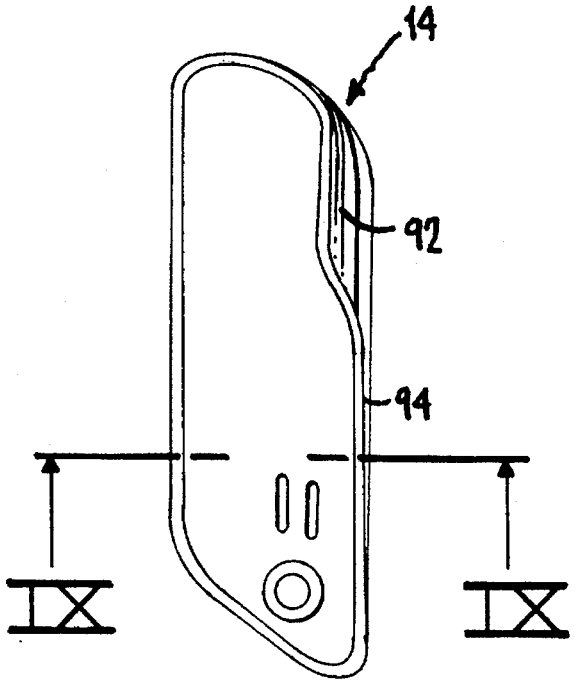
FIG. 8 is a bottom plan view of the left palm rest.
Figure 9:
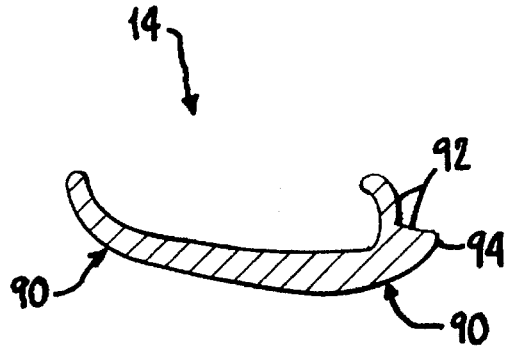
FIG. 9 is an enlarged sectional view taken along line IX—IX in FIG. 8.

In FIGS. 8 and 9, the palm rests 14 are shaped and size for comfort to the operator who otherwise might suffer fatigue or, worse, the symptoms of repetitive stress injury or carpal tunnel syndrome and the like. For this purpose, the palm rests 14 have convex upper surfaces 90. The convex upper surfaces 90 are positionable in elevations relatively flush with the home row of keyboards (i. e., the row with the space bar) because of concave rear sidewalls 92, which define a relatively thin flange 94. The concave rear sidewalls 92 and flange 94 cooperatively act on the front edge or edge portions of the keyboard to clamp the keyboard in place.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A support apparatus comprising:

a base portion defining a working surface on which to place an item to be supported; at least one abutment member defined on the working surface for abutting a rear portion of the item on the working surface;

dual palm rests positionable in various clamping relationships against a front edge of the item on the working surface toward the abutment member ;

a carriage movably connected to the base portion for displacement of the dual palm rest in a front to back direction relative to the front edge of the item;

interconnecting means for interconnecting the palm rests with the carriage such that each palm rest can swivel about a swivel axis generally perpendicular to a plane defined by the displacement of the carriage, and such that each palm rest is hinged about a hinge axis that extends in a plane generally perpendicular to the associated swivel axis; and, biasing means for biasing each palm rest about the swivel and hinge axes thereof, and for biasing the carriage toward the front edge of the item on the working surface;

wherein the carriage, dual palm rests, biasing and interconnecting means cooperatively effect a multiply adjustable clamping action on front edge portions of the item on the working surface.

2. The support apparatus of claim 1, further comprising a pair of said at least one abutment members which are adjustable rest assembly releasably securable to the base portion, the abutment members extending up from the working surface for abutting selected positions of a rear portion of the item on the working surface.

3. The support apparatus of claim 1, wherein the palm rests define upper surfaces and concave rearward surfaces shaped for abutting against front edge portions of the item, said item being chosen from one of a computer keyboard, a split computer-keyboard, a laptop computer with an integral keyboard, a graphical tablet, and a writing case.

4. The support apparatus of claim 3, wherein the concave rear surfaces are shaped and arranged to permit the upper surfaces to be positioned in planes relatively flush with a home row of any of the chosen items having keyboards.

5. The support apparatus of claim 1, wherein the interconnecting means comprises a pair of swivel joints and a pair spindles defining the swivel and hinge axes respectively.

6. The support apparatus of claim 1, wherein the biasing means for the carriage comprises one of a coil spring and a shock cord.

7. The support apparatus of claim 1, wherein the biasing means for the palm rests comprise one of sets of torsion springs and leaf springs.

8. The support apparatus of claim 1, wherein the base portion defines a passageway below the working surface, the passageway extending in a left to right direction relative to the front edge of the keyboard on the working surface; and, further comprising a dual side-pad assembly, slidably disposed in the passageway, comprising left and right side pads interconnected with a shaft for counter-rotation relative to each other;

wherein the dual side-pad assembly has a storage position generally occupying the passageway, and left and right extended positions in which one of the left and right side pads extends out from below the working surface;

the dual side-pad assembly further having relatively extreme left and right extended positions in which one of the left and the right side pads respectively is permitted to be rotated to various inclined positions relative to the working surface.

9. The support apparatus of claim 8, wherein the dual side pad assembly includes a frictional-engagement means for frictionally engaging the side pads such that the side pads remain relatively stably positioned in any of the various inclined positions.

10. The support apparatus of claim 9, wherein the frictional-engagement means is adjustable for changing the degree of frictional engagement between the side pads.

11. The support apparatus of claim 8, wherein one side pad is formed with a peripheral groove; and, further comprising a wrist rest for removably attaching to the one side pad via gripping means extending into the groove, the wrist rest being variably positionable on the one side pad in both storage and use positions.

12. The support apparatus of claim 1, further comprising a storage receptacle for storing a cursor positioning device during non-use, the storage receptacle including a first resilient element for removably attaching the storage receptacle to an edge of the base portion and a second resilient element for releasably retaining the cursor positioning device.

13. A support apparatus comprising:

a base portion defining a working surface on which to place an item to be supported;

a palm rest assembly positionable in various clamping relationships with a front edge of the item on the working surface;

the palm rest assembly including a carriage movably connected to the base portion for displacement in a front to back direction relative to the front edge of the item;

the base portion defining a passageway below the working surface, the passageway extending in a left to right direction relative to the front edge of the item on the working surface;

a dual side-pad assembly, slidably disposed in the passageway, comprising left and right side pads interconnected with a shaft for counter rotation relative to each other;

wherein the dual side-pad assembly has a storage position generally occupying the passageway, and left and right extended positions in which one of the left and the right side pads extends out from below the working surface;

the dual side-pad assembly further having relatively extreme left and right extended positions in which one of the left and the right side pads respectively is permitted to be rotated to various inclined positions relative to the working surface.

14. The support apparatus of claim 13, wherein the dual side-pad assembly includes a frictional-engagement means for frictionally engaging the side pads such that the side pads remain relatively stably positioned in any of the various inclined positions.

15. The support apparatus of claim 14, wherein the frictional-engagement means is adjustable for changing the degree of frictional engagement between the side pads.

16. The support apparatus of claim 13, wherein one side pad is formed with a peripheral groove; and, further comprising a wrist rest for removably attaching to the one side pad via gripping means extending into the groove, the wrist rest being variably positionable on the one side pad in both storage and use positions.

17. The support apparatus of claim 13, further comprising a storage receptacle for storing a cursor positioning device during non-use, the storage receptacle including a first resilient element for removably attaching the storage receptacle to an edge of the base portion and a second resilient element for releasably retaining the cursor positioning device.

18. The support apparatus of claim 13, further comprising a pair of adjustable abutment members releasably securable to the base portion, the abutment members extending up from the working surface for abutting various positions of a rear portion of the keyboard on the working surface.

19. The support apparatus of claim 13, wherein the palm rest assembly defines upper surface portions and concave, rearward surface portions shaped for abutting against front edge portions of the item, said item being chosen from one of a computer keyboard, a split computer-keyboard, a laptop computer with an integral keyboard, a graphic tablet, and a writing case, the concave rear surface portions permitting the upper surface portions to be positioned in planes relatively flush with a home row of any of the chosen items having keyboards.

20. The support apparatus of claim 13, wherein the palm rest assembly comprises palm rest portions interconnected with the carriage to swivel about a swivel axis, the palm rest portions being normally biased by torsion springs for clamping.

* * * * *